US009004808B2

(12) United States Patent
Main et al.

(10) Patent No.: US 9,004,808 B2
(45) Date of Patent: Apr. 14, 2015

(54) SYSTEMS FOR CONVERTING AN EXISTING TRAFFIC INTERSECTION INTO AN INTERSECTION HAVING A ROUNDABOUT, AND RELATED METHODS

(71) Applicant: Design Safety Engineering, Inc., Ann Arbor, MI (US)

(72) Inventors: Bruce W. Main, Ypsilanti, MI (US); McKinnon S. Main, Ypsilanti, MI (US)

(73) Assignee: Design Safety Engineering, Inc., Ann Arbor, MI (US)

( * ) Notice: Subject to any disclaimer, the term of this patent is extended or adjusted under 35 U.S.C. 154(b) by 0 days.

(21) Appl. No.: 14/193,805

(22) Filed: Feb. 28, 2014

(65) Prior Publication Data

US 2014/0270938 A1 Sep. 18, 2014

Related U.S. Application Data

(60) Provisional application No. 61/782,306, filed on Mar. 14, 2013.

(51) Int. Cl.
*E01C 1/02* (2006.01)
*E01F 1/00* (2006.01)

(52) U.S. Cl.
CPC .... *E01C 1/02* (2013.01); *E01F 1/00* (2013.01)

(58) Field of Classification Search
CPC ..... E01C 1/02; E01C 1/002; E01F 1/00
USPC ..... 404/1, 7; 52/33
See application file for complete search history.

(56) References Cited

U.S. PATENT DOCUMENTS

| | | | | |
|---|---|---|---|---|
| 6,099,202 | A * | 8/2000 | Walton et al. | 404/8 |
| 7,234,891 | B2 | 6/2007 | Niiya et al. | |
| 7,425,104 | B2 | 9/2008 | Buteliauskas | |
| 7,860,639 | B2 | 12/2010 | Yang | |
| 7,950,872 | B2 * | 5/2011 | Radu, Jr. | 404/7 |
| 8,221,023 | B2 | 7/2012 | Sutchiewcharn et al. | |
| 8,395,530 | B2 | 3/2013 | Al-Hasan | |
| 2002/0076276 | A1 | 6/2002 | Troemel et al. | |
| 2009/0035058 | A1 | 2/2009 | Berman et al. | |
| 2009/0052983 | A1 | 2/2009 | Goj | |
| 2009/0113828 | A1 * | 5/2009 | Radu, Jr. | 52/380 |
| 2011/0221614 | A1 | 9/2011 | Al-Hasan | |

FOREIGN PATENT DOCUMENTS

| | | | |
|---|---|---|---|
| DE | 19525060 | A1 | 1/1996 |
| DE | 10112603 | A1 | 10/2002 |
| EP | 1199408 | A1 | 4/2002 |

(Continued)

*Primary Examiner* — Abigail A Risic
(74) *Attorney, Agent, or Firm* — Wood, Herron & Evans, LLP

(57) ABSTRACT

A system for converting an existing traffic intersection into an intersection having a roundabout traffic control feature includes a center island framework, one or more splitter island frameworks, and one or more diverter frameworks. The frameworks are secured to the road surface, and fill material is added to free spaces defined in the frameworks to thereby form a center island, one or more splitter islands, and one or more diverters. The system allows a roundabout to be implemented into an existing intersection on a temporary or semi-permanent basis, in a minimal amount of time and without requiring significant construction at the site of the intersection.

30 Claims, 6 Drawing Sheets

(56) References Cited

FOREIGN PATENT DOCUMENTS

| | | | |
|---|---|---|---|
| EP | 2189572 | A2 | 5/2010 |
| EP | 2278070 | A2 | 1/2011 |
| UA | 2195381 | | 4/1988 |
| UA | 2291673 | | 1/1996 |
| UA | 2310235 | | 8/1997 |
| UA | 2413142 | | 10/2005 |
| WO | 9746990 | A1 | 12/1997 |
| WO | 2012007796 | A1 | 1/2012 |
| WO | 2012045289 | A1 | 4/2012 |

* cited by examiner

SYSTEMS FOR CONVERTING AN EXISTING TRAFFIC INTERSECTION INTO AN INTERSECTION HAVING A ROUNDABOUT, AND RELATED METHODS

This claims the benefit of U.S. Provisional Patent Application Ser. No. 61/782,306, filed Mar. 14, 2013 and hereby incorporated by reference in its entirety.

BACKGROUND OF THE INVENTION

This invention relates to the field of traffic engineering, and more particularly, to controlling vehicle traffic at intersections where roads meet.

Vehicle traffic through roadway intersections where roads meet has traditionally been controlled by traffic lights and signage. For example, at a conventional intersection of two roads, a traffic light is positioned to intermittently stop the movement of traffic along one road while traffic proceeds along the other road through the traffic intersection. After a period of time, the traffic light is adjusted to stop movement along the one road and permit movement along the other road. Traffic signs, such as stop signs, are also used to similarly control a conventional traffic intersection. For example, a four-way traffic stop can include stop signs on each road to stop the movement of vehicles on both roads before entering the traffic intersection. Also, a two-way traffic stop can include stop signs on one of the roads to stop the movement of vehicles on that road before entering the traffic intersection.

Roundabouts are another traffic control feature that are used to control vehicle traffic at traffic intersections. In a typical intersection having a roundabout, an island is located at the center of the traffic intersection and one or more roundabout lanes follow a generally circular path around the island. Vehicle traffic approaches the traffic intersection and enters the roundabout lane(s). Vehicle traffic follows the roundabout lane(s) until exiting the traffic intersection along a desired road.

Roundabouts are considered to provide advantages over conventional traffic lights and signs for controlling vehicle traffic. At some intersections, for example, a roundabout may be a safer, more efficient, and/or environmentally better option for controlling traffic than conventional traffic lights and signs. However, constructing roundabouts typically presents additional considerations and other problems. For example, a traffic intersection having a roundabout may occupy a larger amount of roadway space than a conventional traffic intersection without the roundabout. Thus, building a traffic intersection having a roundabout may require more land than a conventional traffic intersection. In addition, the construction of traffic intersections requires substantial manpower, equipment, and resources. For example, the location of a traffic intersection is typically prepared using large and expensive construction machinery. This construction work can take several weeks to complete. And if a conventional traffic intersection is converted into a traffic intersection having a roundabout, this typically requires demolition and/or removal of the existing intersection before a roundabout is constructed. Such removal often requires work by such construction machinery, thereby making such a project costly, both in terms of financial resources and the amount of time the traffic intersection is under construction and mostly unusable. For example, roundabout traffic intersection construction projects can take from as little as several weeks up to several months, depending on the complexity of the intersection. In addition, the intersection may be unusable during some or all of the construction. Also, if additional land is required to add a roundabout, acquiring the additional land can add to the time and expense associated with the construction project.

SUMMARY OF THE INVENTION

These and other shortcomings in the prior art have been addressed in various embodiments of this invention. In a first embodiment, a system is provided for converting an existing traffic intersection into an intersection having a roundabout traffic control feature. The intersection is formed at the junction of at least two road sections, each road section extending between road edges. A road surface is defined by the road sections and the intersection. The system includes a center island framework located centrally in the intersection, and for vehicle traffic to move around. The center island framework includes center island free spaces which receive fill material. The center island framework includes mounting brackets which secure the center island framework to the road surface. A splitter island framework may be included near the junction of a road section and the intersection to guide vehicle traffic from the road section entering into the intersection and from the intersection exiting to another road section. The splitter island framework may include a number of splitter island free spaces which receive fill material. The splitter island framework may also include mounting brackets for securing the splitter island framework to the work surface. A diverter framework may be positioned near a road edge and the intersection to guide vehicle traffic away from the road edge. The diverter framework may include diverter free spaces which receive fill material. The diverter framework may further include mounting brackets for securing the diverter framework to the road surface.

The system allows a roundabout traffic control feature to be included in a traffic intersection on a semi-permanent or temporary basis, without requiring significant construction at the site of the intersection. Advantageously, the system allows a roundabout to be added to an existing traffic intersection in a minimal amount of time, thereby minimizing the amount of time that the traffic intersection is unusable during the conversion process.

In another embodiment, a method is provided for converting an existing traffic intersection into an intersection having a roundabout traffic control feature. The intersection is formed at the junction of multiple road sections, each road section extending between road edges. The method includes securing a center island framework to the road surface in a generally central location of the intersection. The center island framework has a number of center island free spaces. The center island free spaces are filled with fill material to form a center island. The method further includes securing a splitter island framework to the road surface near the junction of a road section and the intersection. The splitter island framework includes a number of splitter island free spaces. The splitter island free spaces are filled with fill material to form a splitter island. The method further includes securing a diverter framework to the road surface near a road edge and the intersection. The diverter framework has diverter free spaces. The diverter framework free spaces are filled with fill material to form a diverter.

The method can be performed relatively quickly and using relatively fewer resources, as compared with traditional roadway construction techniques. Thus, a roundabout can be added to an existing traffic intersection in a minimal amount of time and using a minimum amount of resources.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

DETAILED DESCRIPTION OF THE INVENTION

Figure 1:
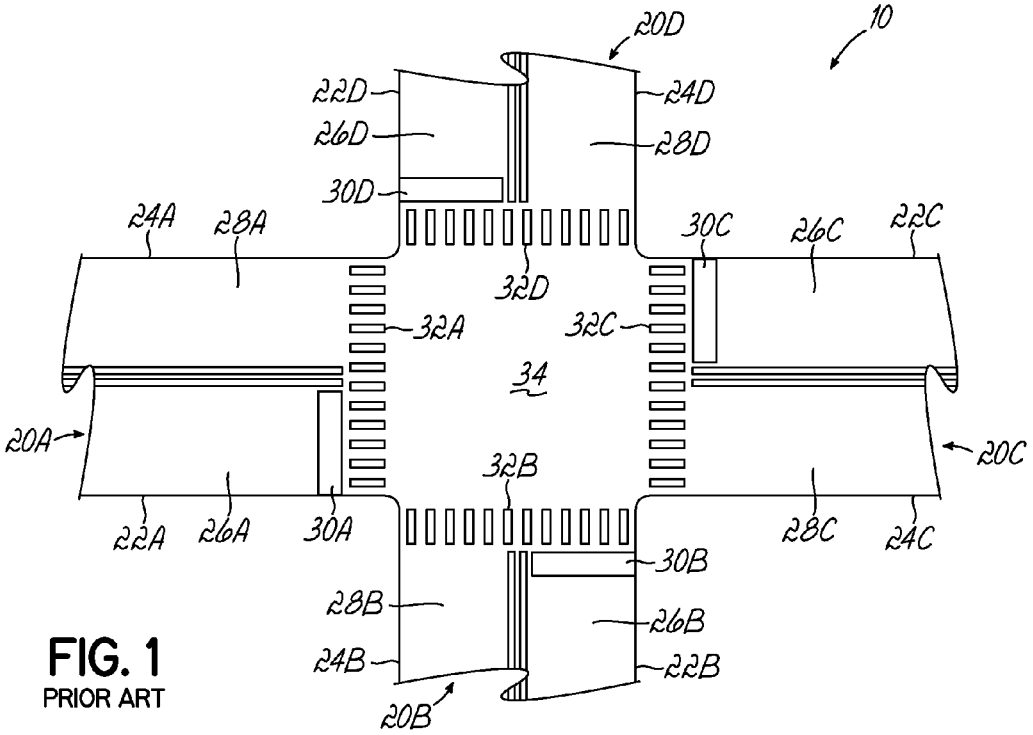
FIG. 1 PRIOR ART
FIG. 1 is a schematic plan view of an existing traffic intersection formed at the junction of several road sections.

With reference to the figures, a system is shown for converting an existing traffic intersection 10 (FIG. 1) into a traffic intersection 12 (FIG. 2) having a roundabout traffic control feature. The system may include a center island 14, several splitter islands 16, and several diverters 18.

The existing traffic intersection 10 shown in FIG. 1 is generally formed at the junction of four road sections 20 (labeled 20A, 20B, 20C, and 20D, respectively); however, this invention may be used at intersections of any number of road sections. Each road section 20 extends between respective road edges 22, 24 (22A, 24A; 22B, 24B; 22C, 24C; and 22D, 24D). Each road section 20 includes two traffic lanes 26, 28 (26A, 28A; 26B, 28B; 26C, 28C; and 26D, 28D), with each traffic lane 26 leading into the traffic intersection 10, and each traffic lane 28 leading away from the traffic intersection 10.

Each road section 20 may also include a traffic stop line 30 (30A, 30B, 30C, and 30D) where vehicles may stop before entering the traffic intersection 10. Each road section 20 may also include a crosswalk 32 (32A, 32B, 32C, and 32D) for pedestrian traffic to cross the respective road section 20. A road surface 34 is defined by the road sections 20 and the traffic intersection 10.

The existing traffic intersection 10 is configured to be controlled by conventional means, such as a traffic light or stop signs. The existing traffic intersection 10 is converted into the traffic intersection 12 having a roundabout traffic control feature according to aspects of this invention by adding the center island 14, one or more splitter islands 16, and one or more diverters 18, as will be described further below. Once the traffic intersection 12 is formed, vehicle traffic enters the traffic intersection 12 and follows a roundabout lane 40 around the center island 14 until exiting the roundabout lane 40 to travel down a desired road section 20. The splitter islands 16 and diverters 18 help direct vehicle traffic into, through, and out of the roundabout lane 40. The splitter islands 16 and diverters 18 also encourage drivers to reduce their speed in and near the intersection 12, and discourage drivers from driving directly through the intersection 12. The splitter islands 16 and 18 thereby contribute to "traffic calming" near the intersection 12. Advantageously, the traffic intersection 12 with the roundabout traffic control feature of this invention no longer requires the conventional means for controlling traffic which were used with the existing traffic intersection 10, and may provide improved throughput of vehicle traffic and other advantages.

Figure 2:
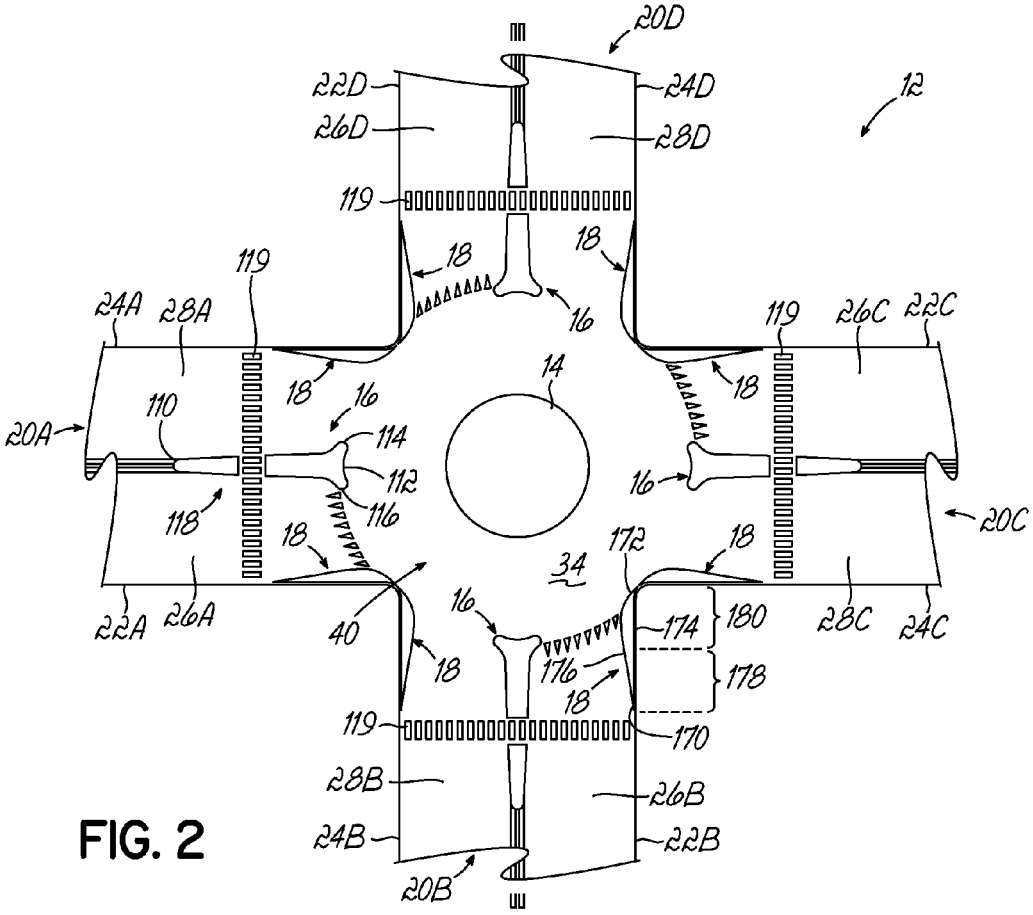
FIG. 2 is a schematic plan view of the traffic intersection of FIG. 1 after features providing a roundabout traffic control feature have been installed according to one aspect of this invention, including a center island in the intersection, a splitter island in each road section near the intersection, and diverters in each road section near the intersection.

As shown in FIG. 2, the center island 14 is positioned in a generally central location of the traffic intersection 12. The center island 14 has a generally circular outer shape when viewed from above and is configured for vehicle traffic to move in a generally circular path around it, following the roundabout lane 40. Each splitter island 16 is positioned near the junction of a road section 20 and the traffic intersection 12. The splitter islands 16 are configured to guide vehicle traffic from a road section 20 into the roundabout lane 40 of the traffic intersection 12, and from the roundabout lane 40 of the traffic intersection 12 into a road section 20. Each diverter 18 is positioned near a road edge 22, 24 and the traffic intersection 12. The diverters 18 are configured to guide vehicle traffic away from the road edges 22, 24 as vehicles enter and exit the roundabout lane 40 of the traffic intersection 12.

Figure 3:
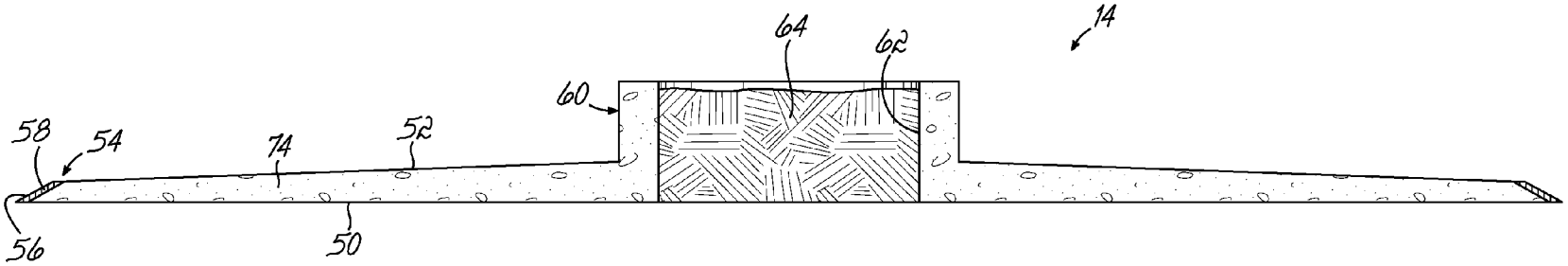
FIG. 3 is a cross-sectional view of a center island according to principles of this invention.

Features of the center island 14 are shown in FIG. 3. The center island 14 generally includes a lower surface 50 configured to be situated on the road surface 34. As shown, the lower surface 50 is generally planar, but may be constructed to otherwise conform to the shape of the road surface 34. The center island 14 also generally includes an upper, or apron, surface 52. A curb 54 is formed between the lower surface 50 and the apron surface 52 at an outer periphery 56 of the center island 14. In the particular embodiment shown, the curb 54 is formed by a curb member 58 which extends generally between the lower surface 50 and the apron surface 52 and which may be formed of steel, for example. As shown, the curb 54 and the curb member 58 extend at a non-perpendicular angle with respect to a plane of the lower surface 50. If a vehicle drives too near the center island 14, the vehicle would drive on the angled curb 54 or curb member 58 and onto the apron surface 52. Alternatively, the curb 54 and/or curb member 58 could be disposed at a perpendicular angle with respect to the plane of the lower surface 50 to discourage vehicles from driving onto the apron surface 52 of the center island 14.

The center island 14 further includes an optional inner curb 60 located radially inward from the curb 54. The inner curb 60 extends upwardly above the apron surface 52, as shown. An open space 62 is radially inward from the inner curb 60 and is filled with a fixture 64, which may be a planter for incorporating decorative vegetation into the center island 14.

Figure 4A:
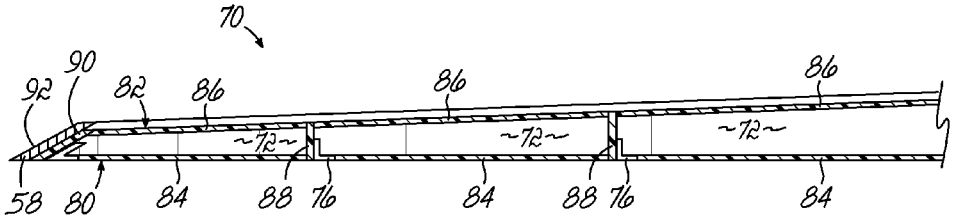
FIGS. 4A and 4B are partial cross-sectional views of center island frameworks used to form center islands according to principles of this invention.
Figure 4B:
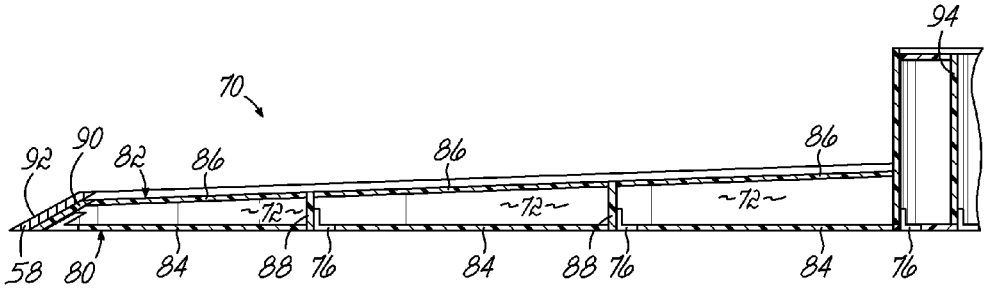
Figure 4C:
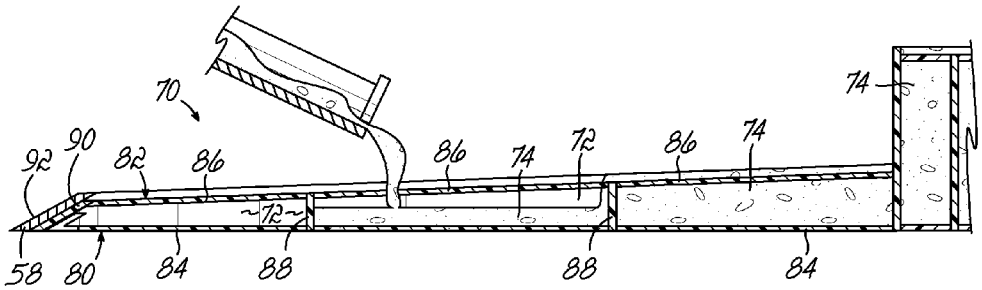
FIG. 4C shows fill material being added into free spaces of the center island framework of FIG. 4B.

The center island 14 may advantageously be formed at the site of an existing traffic intersection 12. In particular, the center island 14 is formed from a center island framework 70, as shown in FIGS. 4A-4C. The center island framework 70 has a number of center island free spaces 72 to receive fill material 74, as shown. The center island framework 70 includes a number of mounting brackets 76 for securing the center island framework 70 to the road surface 34. The center island framework 70 may be constructed to accommodate crowning, sloping, or other non-level attributes of the site of the intersection 12.

The center island framework 70 includes a lower center island frame 80 and an upper center island frame 82. The lower center island frame 80 includes a number of interconnected frame segments 84, and the upper center island frame 82 includes a number of interconnected frame segments 86. The lower center island frame 80 and the upper center island frame 82 are connected by a number of connecting frame segments 88. The center island free spaces 72 are generally formed between the various frame segments 84, 86, 88. The mounting brackets 76 may be secured to the lower center island frame 80, and may include flat plate style brackets, for example. The curb member 58 may extend above the upper center island frame 82, as shown in FIGS. 4A-4C.

The center island framework 70 has an outer peripheral wall 90 at an outer periphery 92. The center island framework 70 has a generally circular shape when viewed from the top. The curb 54 of the center island 14 is formed at the outer periphery 92 and generally radially inward from the outer peripheral wall 90. The center island framework 70 may include the curb member 58 at the location of the outer peripheral wall 90 and/or the outer periphery 92. Thereby, the center island free spaces 72 are formed radially inward from the curb member 58.

As shown, the lower center island frame 80 is generally planar, with the frame segments 84 thereof extending in generally the same plane. In the embodiment shown, the curb member 58 extends at a non-perpendicular angle with respect to the plane of the lower center island frame 80. Alternatively, the curb member 58 could be oriented so as to extend at a perpendicular angle to the plane of the lower center island frame 80.

The center island framework 70 also includes an optional inner wall 94 located radially inwardly from the outer peripheral wall 90 and the outer periphery 92. The inner curb 60 of the center island 14 is formed radially outward from the inner wall 94. Where such an inner wall 94 is included, the center island framework 70 has a generally ring shape when viewed from the top.

Figure 5:
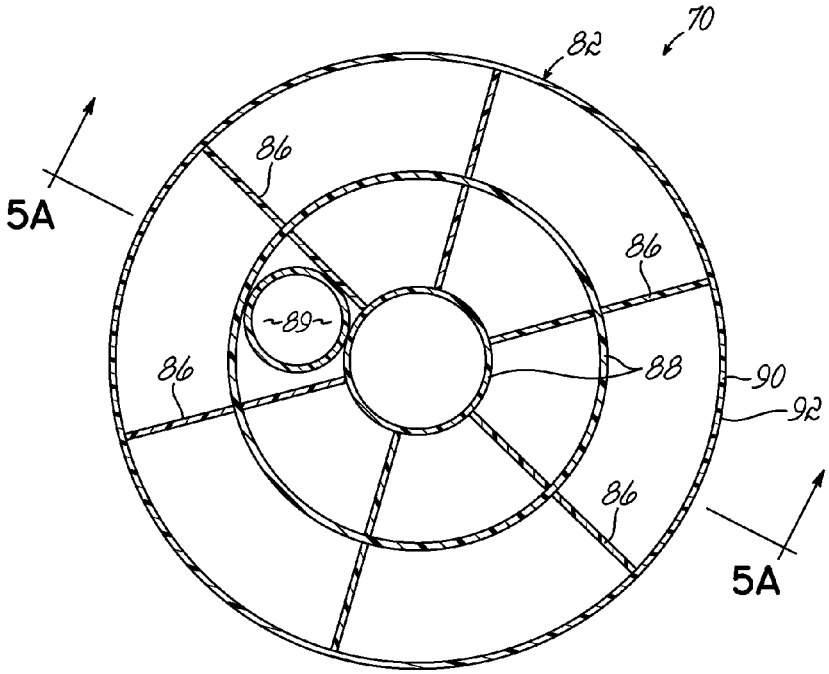
FIG. 5 is a plan view of a center island framework according to principles of this invention.

FIGS. 5 and 5A-5E show that the center island framework 70 can be constructed to have various profiles. FIG. 5 generally shows the center island framework 70 from the top, with the upper center island frame 82 and its frame segments 86 being visible. FIGS. 5A-5E are cross-sectional views showing the lower center island frame 80, the upper center island frame 82, and the connecting frame segments 88. As shown, the connecting frame segments 88 extend at a generally perpendicular angle with respect to the plane of the lower center island frame 80. FIG. 5 also shows that the center island framework 70 can include a utility access space 89 to provide access to a manhole, for example.

Figure 5A:
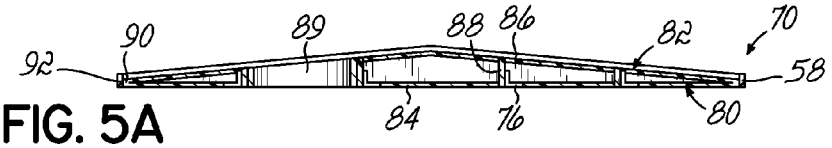
FIGS. 5A-5E are cross sectional views of the center island framework of FIG. 5 taken along line 5A-5A of FIG. 5 and showing exemplary profiles of the center island framework of FIG. 5.

FIG. 5A shows a configuration with a small sized outer peripheral wall 90. Also, FIG. 5A shows the frame segments 86 of the upper center island frame 82 extending at an inclined angle with respect to the plane of the frame segments 84 of the lower center island frame 80.

Figure 5B:
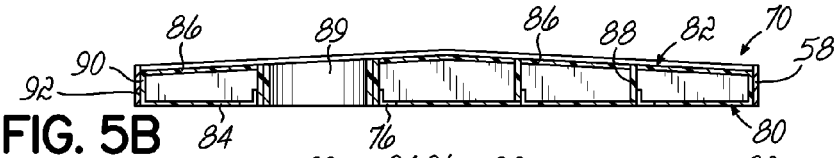

FIG. 5B shows an embodiment of the center island frame 80 with an intermediate sized outer peripheral wall 90. And like FIG. 5A, FIG. 5B shows the frame segments 86 of the upper center island frame 82 extending at an inclined angle with respect to the plane of the frame segments 84 of the lower center island frame 80.

Figure 5C:
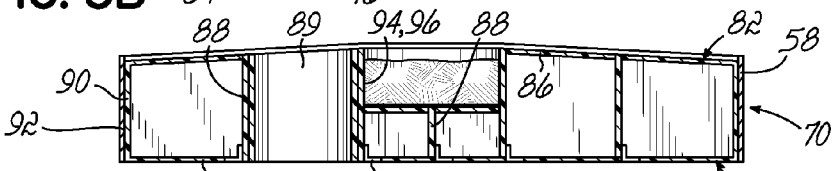

FIG. 5C shows an embodiment of the center island frame 80 with a large sized outer peripheral wall. And like FIGS. 5A and 5B, FIG. 5C shows the frame segments 86 of the upper center island frame 82 extending at an inclined angle with respect to the plane of the frame segments 84 of the lower center island frame 80. FIG. 5C also shows a socket 96 formed in the center island framework 70. The socket 96 is configured to receive a fixture 64, such as a planter, similar to what is included in the open space 62 discussed above. The socket 96 extends into the center island framework 70 below the upper center island frame 82 and stops before reaching the lower center island frame 80.

FIGS. 5A-5C show center island frameworks 70 of various heights, with FIG. 5A being the shortest, and FIG. 5C being the tallest. The size of the connecting frame segments 88 may be chosen to provide a center island framework 70 of a desired height.

Figure 5D:
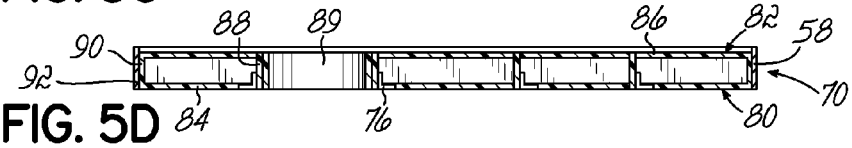
Figure 5E:
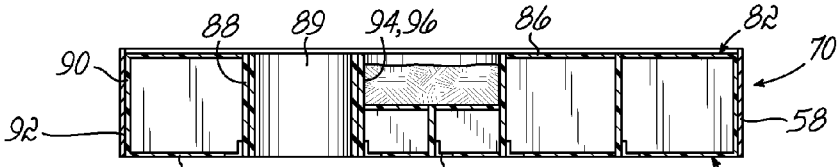

FIGS. 5D and 5E show configurations where the frame segments 86 of the upper center island frame 82 extending generally parallel with respect to the plane of the frame segments 84 of the lower center island frame 80. The upper center island frame 82 may extend generally parallel with the plane of the lower center island frame 80. The center island framework 70 shown in FIG. 5D is shorter than the center island framework 70 of FIG. 5E. In addition, the center island framework 70 shown in FIG. 5E includes a socket 96 configured to receive a fixture, such as a planter, as discussed above.

The center island framework 70 may be provided as a single unitary piece. Alternatively, a plurality of center island framework segments may be provided which together form the center island framework 70.

The center island framework 70 is secured to the road surface 34 via the mounting brackets 76, such as by using bolts or adhesive, for example constructive epoxy. If the center island framework 70 is provided by a plurality of center island framework segments, each of the center island framework segments is secured to the road surface 34. Fill material 74 is added to the center island free spaces 72 to thereby form the center island 14. For example, the fill material 74 is added after the center island framework 70 is secured to the road surface 34. As shown in FIG. 4C, the fill material 74 may be added to cover the upper center island frame 82 such that all the various frame segments 84, 86, 88 are covered by fill material 74. The fill material 74 may be added to generally reach or pass the upper extent of the curb member 58, such that the fill material 74 extends generally between the lower surface 50 and the apron surface 52 of the center island 14. A fixture 64 may be positioned in an open space 62 or socket 96, if one is provided. Advantageously, the center island framework 70 and other components of this invention can be secured to the road surface with minimal, if any, modifications to the existing intersection.

Figure 6:
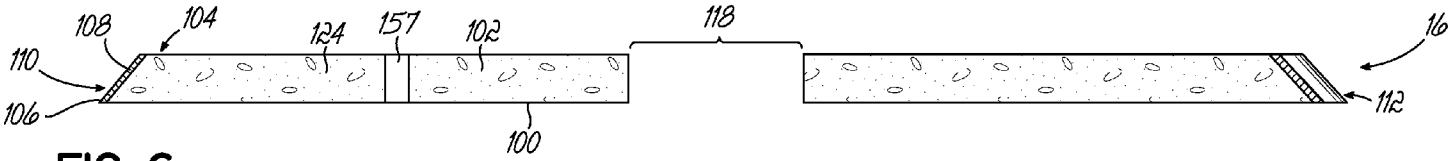
FIG. 6 is a cross-sectional view of a splitter island according to principles of this invention.

Referring next to FIG. 6, features of a splitter island 16 are shown. The splitter island 16 generally includes a lower surface 100 configured to be situated on the road surface 34. As shown, the lower surface 100 is generally planar, but may be constructed to otherwise conform to the shape of the road surface 34. The splitter island 16 also includes an upper, or apron, surface 102. As shown, the apron surface 102 extends generally parallel with the lower surface 100. A curb 104 is formed between the lower surface 100 and the apron surface 102 at an outer periphery 106 of the splitter island 16. In the embodiment shown, the curb 104 is formed by a curb member 108 which extends generally between the lower surface 100 and the upper surface 102 and which may be formed of steel, for example. As shown, the curb 104 and the curb member 108 extend at a non-perpendicular angle with respect to a plane of the lower surface 100. Alternatively, the curb 104 and/or curb member 108 could be disposed at a perpendicular angle with respect to the plane of the lower surface 100 to discourage vehicles from driving onto the apron surface 102.

As shown in FIG. 2, each splitter island 16 generally extends between a first end no and a second end 112 along a length in the direction of a road section 20. The second end 112 is nearer the traffic intersection 12 than the first end 110. A first lobe 114 and a second lobe 116 are formed at the second end 112 of a splitter island 16. The first lobe 114 is configured for guiding traffic from the roundabout lane 40 of the traffic intersection 12 into a road section 20. The second lobe 116 is configured for guiding traffic from a road section 20 into the roundabout lane 40 of the traffic intersection 12. The splitter islands 16 also encourage drivers to reduce their vehicle speed as the drivers approach and enter the intersection 12, and discourage the drivers from driving directly through the intersection 12 and over the center island 14. Each splitter island 16 has a generally "Y" shape and may also include a free space 118 to accommodate a pedestrian walkway or crosswalk 119 according to various embodiments of this invention.

Figure 7A:
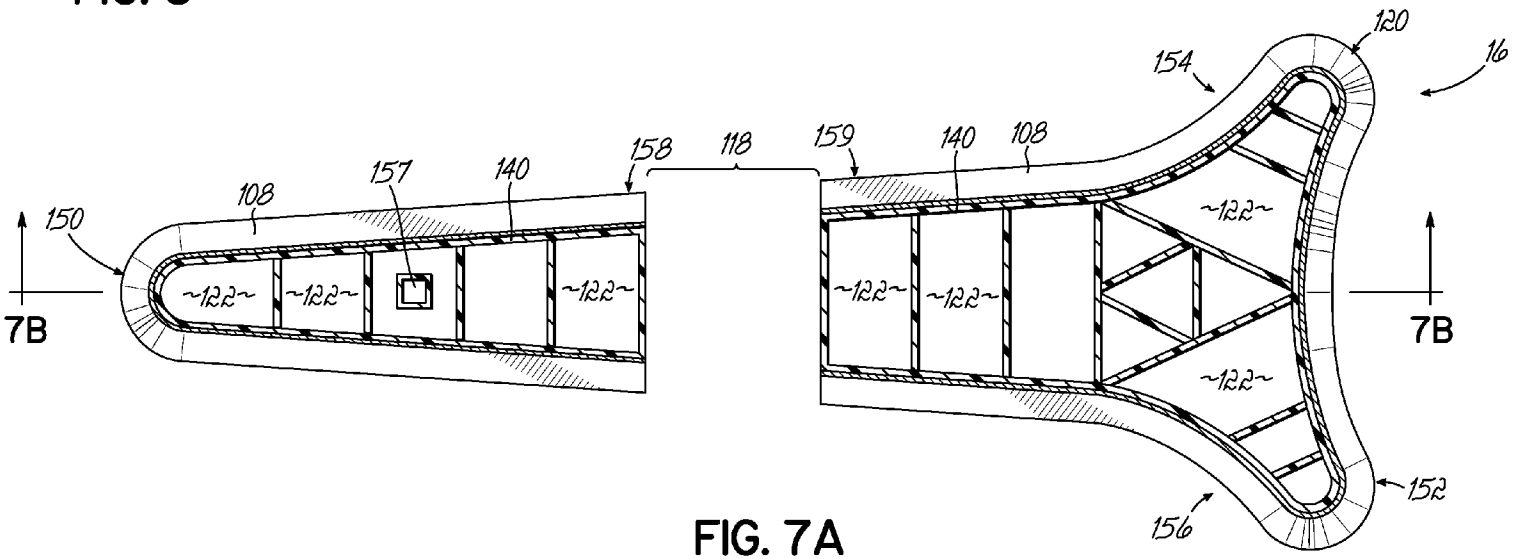
FIG. 7A is a plan view of a splitter island framework used to form the splitter island of FIG. 6.
Figure 7B:
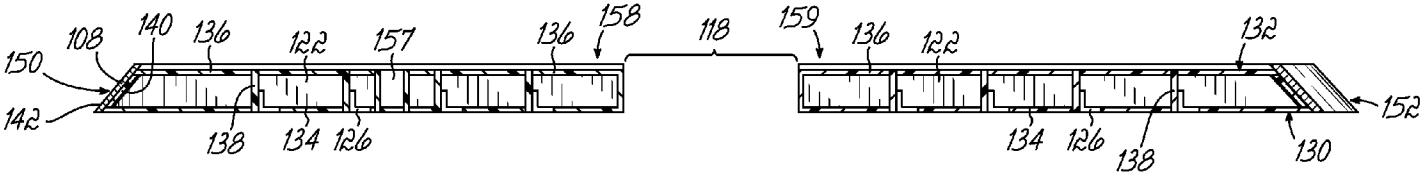
FIG. 7B is a cross-sectional view of the splitter island framework of FIG. 7A taken along line 7B-7B of FIG. 7A.

The splitter island 16 may advantageously be formed at the site of the traffic intersection 12. In particular, the splitter island 16 is formed from a splitter island framework 120, as shown in FIGS. 7A and 7B. The splitter island framework 120 has a number of splitter island free spaces 122 to receive fill material 124 (FIG. 6). The splitter island framework 120 has a number of mounting brackets 126 configured for securing the splitter island framework 120 to the road surface 34. The splitter island framework 120 may be constructed to accommodate crowning, sloping, or other non-level attributes of the site of the intersection 12.

The splitter island framework 120 generally includes a lower splitter island frame 130 and an upper splitter island frame 132. The lower splitter island frame 130 includes a number of interconnected frame segments 134, and the upper splitter island frame 132 includes a number of interconnected frame segments 136. The lower splitter island frame 130 and the upper splitter island frame 132 are connected by connecting frame segments 138. The splitter island free spaces 122 are generally defined between the various frame segments 134, 136, 138. The mounting brackets 126 may be secured to the lower splitter island frame 130, and may include flat plate style brackets, for example. The curb member 108 may extend above the upper splitter island frame 132, as shown in FIG. 7B.

The splitter island framework 120 has an outer peripheral wall 140 at an outer periphery 142. The curb 104 of the splitter island 16 is formed at the outer periphery 142 inward from the outer peripheral wall 140. The splitter island framework 120 may include the curb member 108 at the location of the outer peripheral wall 140 and the outer periphery 142. The splitter island free spaces 122 may be radially inward from the curb member 108.

As shown, the lower splitter island frame 130 is generally planar, with the frame segments 134 thereof extending in generally the same plane. In the embodiment shown, the curb member 108 extends at a non-perpendicular angle with respect to the plane of the lower splitter island frame 130. Alternatively, the curb member 108 could be oriented so as to extend at a perpendicular angle to the plane of the lower splitter island frame 130.

The splitter island framework 120 extends between a first end 150 and a second end 152, which generally correspond with the first end 110 and second end 112 of the splitter island 16. The splitter island framework 120 includes a first lobe 154 and a second lobe 156 configured for forming the first lobe 114 and the second lobe 116 of the splitter island 16.

Optionally, the splitter island framework 120 may include a first portion 158 and a second portion 159. The first portion 158 includes the first end 150, and the second portion 159 includes the second end 152 and the first and second lobes 154, 156. The first portion 158 is spaced from the second portion 159 on the road surface 34 to provide the free space 118 of the splitter island 16 to accommodate a pedestrian walkway 119 between the first portion 158 and the second portion 159. The first portion 158 and the second portion 159 may be formed separately from one another.

The splitter island framework 120 may also optionally include a post socket 157 for receiving a sign post (not shown) in the splitter island 16.

The splitter island framework 120 may be provided as a single unitary piece, or as a single unitary piece for each of the first portion 158 and the second portion 159. Alternatively, a number of splitter island framework segments may be provided which together form the splitter island framework 120. For example, each or both of the first portion 158 and second portion 159 may be formed of a number of splitter island framework segments.

The splitter island framework 120 is secured to the road surface 34 via the mounting brackets 126, such as by using bolts or adhesive, for example construction epoxy. If the splitter island framework 120 is provided by a number of splitter island framework segments, each of the splitter island framework segments is secured to the road surface 34. Fill material 124 is added to the splitter island free spaces 122 to thereby form the splitter island 16. For example, the fill material 124 is added after the splitter island framework 120 is secured to the road surface 34. The fill material 124 may be added to cover the upper splitter island frame 132 such that all the various frame segments 134, 136, 138 are covered by fill material 124. The fill material 124 may be added to generally reach or pass the upper extent of the curb member 108, such that the fill material 124 extends generally between the lower surface 100 and the upper surface 102 of the splitter island 16.

Figure 8:
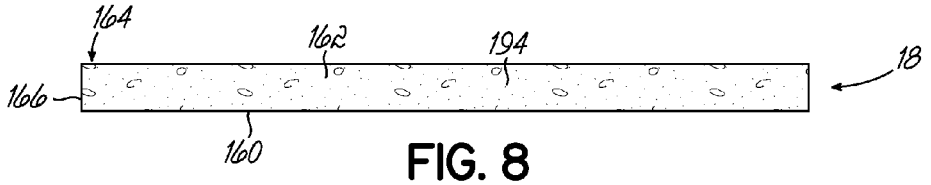
FIG. 8 is a cross-sectional view of a diverter according to principles of this invention.

Referring next to FIG. 8, features of the diverter 18 are shown. The diverter 18 generally includes a lower surface 160 configured to be situated on the road surface 34. As shown, the lower surface 160 is generally planar, but may be constructed to otherwise conform to the shape of the road surface 34. The diverter 18 also generally includes an upper surface 162. As shown, the upper surface 162 extends generally parallel with the lower surface 160. A curb 164 is formed between the lower surface 160 and the upper surface 162 at an outer periphery 166 of the diverter. As shown, the curb 164 extends at a perpendicular angle with respect to a plane of the lower surface 160. This discourage vehicles from driving onto the diverter 18.

The diverters 18 are configured to guide vehicle traffic into the roundabout lane 40 and away from the road edges 22, 24. In addition, the diverters 18 also encourage drivers to reduce their vehicle speed as the drivers approach and enter the intersection 12, and discourage the drivers from driving directly through the intersection 12 and over the center island 14. As shown in FIG. 2, each diverter 18 generally extends between a first end 170 and a second end 172 along a length in the direction of the road section 20. The second end 172 is nearer the traffic intersection 12 than the first end 170. Each diverter 18 includes a first side 174 and a second side 176. The first side 174 is configured to be positioned adjacent one of the road edges 22, 24, and the second side 176 is spaced from the first side 174 toward the interior of the road section 20. The second side 176 generally includes a first portion 178 that expands outwardly away from the first side 174 as the distance from the first end 170 increases. The second side 176 also generally includes a second portion 180 connected with the first portion 178, and that tapers inwardly toward the first side 174 as the distance toward the second end 172 increases. The first portion 178 and second portion 180 of the second side 176 both extend in a generally non-parallel relationship with respect to the first side 174.

Figure 9A:
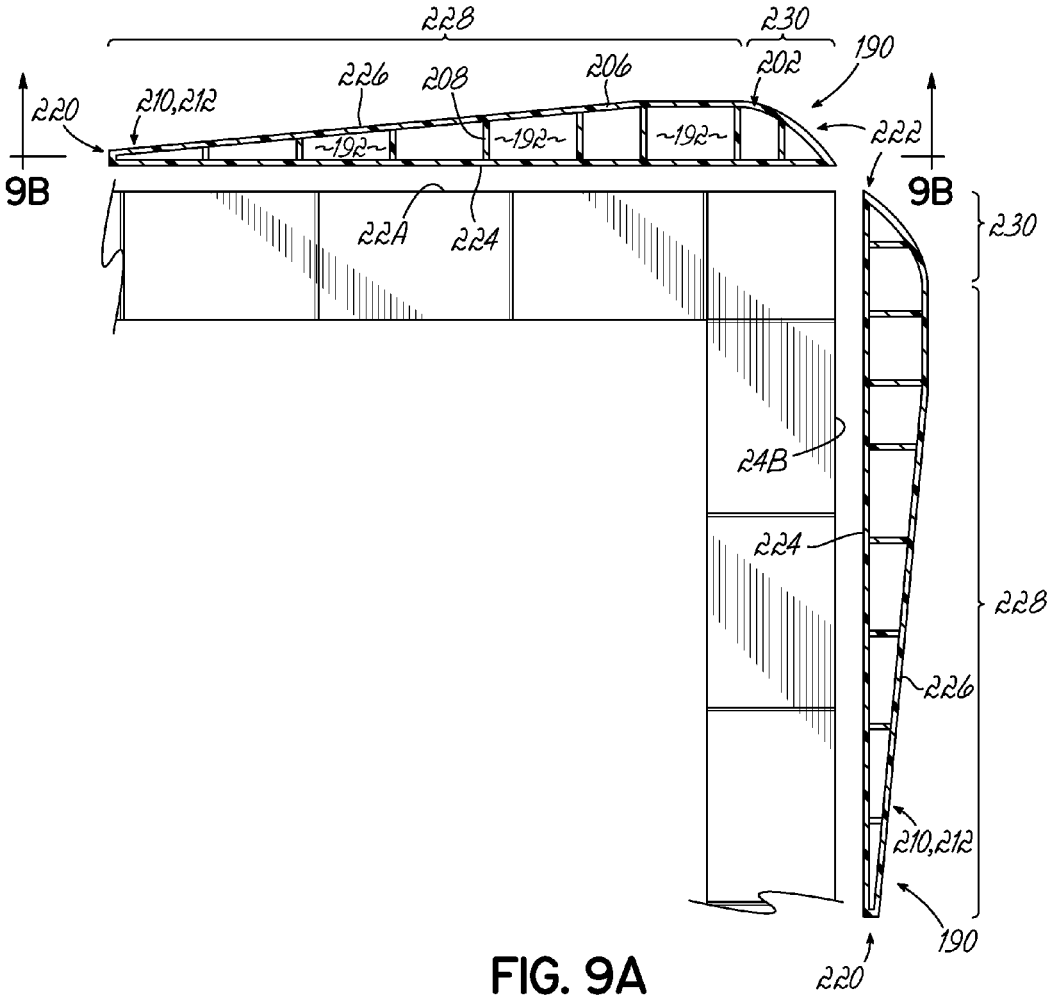
FIG. 9A is a plan view of diverter frameworks used to form the diverter of FIG. 8.
Figure 9B:
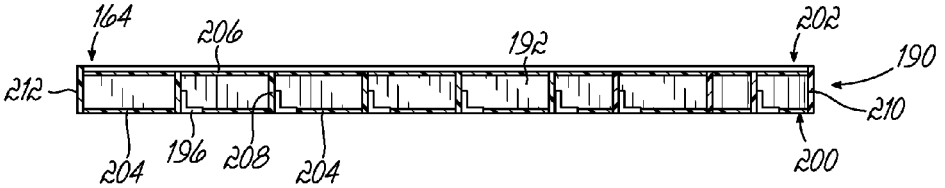
FIG. 9B is a cross-sectional view of one of the diverter frameworks of FIG. 9A taken along line 9B-9B of FIG. 9A.

The diverters 18 may advantageously be formed at the site of the traffic intersection 12. In particular, each diverter 18 is formed from a diverter framework 190, as shown in FIGS. 9A and 9B. The diverter framework 190 defines a number of diverter free spaces 192 to receive fill material 194 (FIG. 8). The diverter framework 190 includes a number of mounting brackets 196 for securing the diverter framework 190 to the road surface 34. The diverter framework 190 may be constructed to accommodate crowning, sloping, or other non-level attributes of the site of the intersection 12.

The diverter framework 190 generally includes a lower diverter frame 200 and an upper diverter frame 202. The lower diverter frame 200 includes a number of interconnected frame segments 204, and the upper diverter frame 202 includes a number of interconnected frame segments 206. The lower diverter frame 200 and the upper diverter frame 202 are connected by a number of connecting frame segments 208. The diverter free spaces 192 are generally defined between the various frame segments 204, 206, 208. The mounting brackets 196 may be secured to the lower diverter frame 200, and may include flat plate style brackets, for example.

The diverter framework 190 defines an outer peripheral wall 210 at an outer periphery 212. The outer peripheral wall 210 may extend above the upper diverter frame 202, as shown in FIG. 9B. The curb 164 of the diverter 18 is formed at the outer periphery 212, generally inward from the outer peripheral wall 210.

The diverter framework 190 extends between a first end 220 and a second end 222, which generally correspond with the first end 170 and second end 172 of the diverter 18. The diverter framework 190 includes a first side 224 and a second side 226, which generally correspond with the first side 174 and the second side 176 of the diverter 18. The second side 226 of the diverter framework 190 includes a first portion 228 and a second portion 230, which generally correspond with the first portion 178 and the second portion 180 of a second side 176 of the diverter 18.

The diverter framework 190 may be provided as a single unitary piece. Alternatively, a plurality of diverter framework segments may be provided which together form the diverter framework 190.

The diverter framework 190 is secured to the road surface 34 via the mounting brackets 196, such as by using bolts or adhesive, for example construction epoxy. If the diverter framework 190 is provided by a number of diverter framework segments, each of the diverter framework segments is secured to the road surface 34. Fill material 194 is added to the diverter free spaces 192 to thereby form the diverter 18. For example, the fill material 194 is added after the diverter framework 190 is secured to the road surface 34. The fill material 194 may be added to cover the upper diverter frame 202 such that all the various frame segments 204, 206, 208 are covered by fill material 194. The fill material 194 may be added to generally reach or pass the upper extent of the outer peripheral wall 210, such that the fill material 194 extends generally between the lower surface 160 and the upper surface 162 of the diverter 18.

The center island framework 70, one or more splitter island frameworks 120, and one or more diverter frameworks 190 can be used to convert an existing traffic intersection, such as traffic intersection 10, to a traffic intersection having a roundabout traffic control feature, such as traffic intersection 12, as follows. The center island framework 70 is secured to the road surface 34 in a generally central location of the traffic intersection 12. If the center island framework 70 is formed of a number of center island framework segments, the center island framework segments are secured to the road surface 34. The center island free spaces 72 are filled with fill material, such as fill material 74, to form the center island 14. If the center island 14 includes the open space 62 or the socket 96, a fixture 64 may be positioned in the open space 62 or the socket 96.

The splitter island framework 120 is secured to the road surface 34 near a junction of the road section 20 and the traffic intersection 12. If the splitter island framework 120 is formed of a number of splitter island framework segments, the splitter island framework segments are secured to the road surface 34. The splitter island free spaces 122 are filled with fill material, such as fill material 124, to form the splitter island 16. If the splitter island framework 120 includes a first portion 158 and a second portion 159, the first portion 158 is secured to the road surface 34 spaced from the second portion 159 to accommodate the pedestrian walkway 119 between the first portion 158 and the second portion 159. This can be repeated for multiple splitter islands 16.

The diverter framework 190 is secured to the road surface 34 near one of the road edges 22, 24. If the diverter framework 190 is formed of a plurality of diverter framework segments, the diverter framework segments are secured to the road surface 34. The diverter free spaces 192 are filled with fill material, such as fill material 194, to form the diverter 18. This can be repeated for multiple diverters 18.

Advantageously, the center island framework 70, one or more splitter island frameworks 120, and one or more diverter frameworks 190 can be provided as a collection of components, or system, for converting an existing traffic intersection, such as traffic intersection 10, into an intersection having a roundabout traffic control feature, such as traffic intersection 12, all without much, if any, re-work of the topography of the intersection 10. Further advantageously, the same fill material can be used as fill material 74, 124, and 194 for the center island framework 70, splitter island frameworks 120, and diverter frameworks 190, respectively. Alternatively, different fill materials can be used for the fill material 74, 124, and 194 for the center island framework 70, splitter island frameworks 120, and diverter frameworks 190, respectively. And while the fill material 74, 124, 194 may be added after the respective frameworks 70, 120, 190 are secured to the road surface 34, they could also be partially or entirely added before the respective frameworks 70, 120, 190 are secured to the road surface 34. Asphalt, concrete, dirt, clay stone, and other suitable materials may be used as fill material.

In addition, the center island framework 70, splitter island frameworks 120, and diverter frameworks 190 can be formed of any suitable material, such as metal, concrete, plastic, combinations thereof, and others. Also, the center island framework 70, splitter island frameworks 120, and diverter frameworks 190 may also be secured to the road surface 34 using bolts or adhesive, as discussed above, or a combination of bolts and adhesive, or using any other suitable structure, material, or method. In these or other embodiments, the mounting brackets 76, 126, and 196 may not be required or used, and therefore may not be included on the respective frameworks 70, 120, and 190.

Advantageously, the center island framework 70, one or more splitter island frameworks 120, and one or more diverter frameworks 190 allow a roundabout traffic control feature to be included in a traffic intersection on a semi-permanent or temporary basis. For example, an existing intersection can be modified to include a center island 14, one or more splitter islands 16, and one or more diverters 18 using the center island framework 70, one or more splitter island frameworks 120, and one or more diverter frameworks 190, as discussed above. These features can be left in the intersection indefinitely or until such time as it is appropriate to remove them. For example, a community may temporarily convert an existing intersection to an intersection having a roundabout as disclosed above in order to assess whether it is desirable to use a roundabout with that intersection, or other intersections, on a more permanent basis. In addition, the center island framework 70, splitter island frameworks 120, and diverter frameworks 190 can be easily replaced or repaired, as appropriate. And if the center island framework 70, splitter island frameworks 120, and diverter frameworks 190 are provided by framework segments, individual segments thereof can be easily replaced or repaired, as well.

Further advantageously, the center island 14, one or more splitter islands 16, and one or more diverters 18 disclosed herein can be installed into an existing traffic intersection much more quickly than traditional construction techniques for constructing an entirely new intersection having a roundabout. For example, it may be possible to convert an existing intersection into an intersection having a roundabout as disclosed above in as little as a few days, or even as little as a few hours. This is an improvement over conventional construction techniques, which can take several weeks to several months to build a roundabout intersection. In addition, the amount of construction resources required to construct the center island 14, one or more splitter islands 16, and one or more diverters 18 is less than constructing an entirely new intersection having a roundabout. Further still, by converting an existing traffic intersection, as discussed above, it is not necessary to acquire additional land at the site of the intersection to construct an entirely new intersection having a roundabout because the outer profile of the intersection 10 is not altered to arrive at the roundabout intersection 12 according to this invention.

From the above disclosure of the general principles of this invention and the preceding detailed description of at least one embodiment, those skilled in the art will readily comprehend the various modifications to which this invention is susceptible. Therefore, we desire to be limited only by the scope of the following claims and equivalents thereof.

What is claimed is:

1. A system for converting an existing traffic intersection into an intersection having a roundabout traffic control feature, the intersection being formed at the junction of a plurality of road sections, each road section extending between road edges, and a road surface defined by the road sections and the intersection, the system comprising:

a center island framework configured for positioning in a generally central location of the intersection, and for vehicle traffic to move around, the center island framework defining a plurality of center island free spaces configured to receive fill material, the center island framework including a plurality of mounting brackets configured for securing the center island framework to the road surface, a splitter island framework configured for positioning near the junction of a road section and the intersection, and to guide vehicle traffic from the road section into the intersection and from the intersection into the road section, the splitter island framework defining a plurality of splitter island free spaces configured to receive fill material, the splitter island framework including a plurality of mounting brackets configured for securing the splitter island framework to the surface.

2. The system of claim 1 further comprising:

a diverter framework configured for positioning near a road edge and the intersection, and to guide vehicle traffic away from the road edge, the diverter framework defining a plurality of diverter free spaces configured to receive fill material, the diverter framework further including a plurality of mounting brackets configured for securing the diverter framework to the road surface.

3. The system of claim 1, the center island framework including a lower center island frame comprising a plurality of inter-connected frame segments, an upper center island frame comprising a plurality of interconnected frame segments, and a plurality of connecting frame segments connecting the lower center island frame and the upper center island frame.

4. The system of claim 3, the frame segments of the upper center island frame extending generally parallel with the frame segments of the lower center island frame.

5. The system of claim 3, the lower center island frame extending in a first plane, and at least a portion of the frame segments of the upper center island extending at an inclined angle with respect to the first plane.

6. The system of claim 1, the center island framework further including a curb member positioned at an outer periphery of the center island framework.

7. The system of claim 6, the lower center island frame extending in a first plane and the curb member extending at a generally perpendicular angle to the first plane.

8. The system of claim 7, the lower center island frame extending in a first plane and the curb member extending at a non-perpendicular angle with respect to the first plane.

9. The system of claim 1, the center island framework having an outer peripheral wall, and having a generally circular shape when viewed from the top.

10. The system of claim 1, the center island framework having an outer peripheral wall and an inner wall, and having a generally ring shape when viewed from the top.

11. The system of claim 1, the center island framework being formed of a plurality of center island framework segments.

12. The system of claim 1, the splitter island framework including a lower splitter island frame comprising a plurality of inter-connected frame segments, an upper splitter island frame comprising a plurality of interconnected frame segments, and a plurality of connecting frame segments connecting the lower splitter island frame and the upper splitter island frame.

13. The system of claim 1, the splitter island framework further including a curb member positioned at an outer periphery of the splitter island framework.

14. The system of claim 1, the splitter island framework extending between a first end and a second end, and including a first lobe and a second lobe formed at the second end, the first lobe being configured for guiding traffic from the intersection into the road section, and the second lobe being configured for guiding traffic from the road section into the intersection.

15. The system of claim 1, the splitter island framework further including a curb member positioned at an outer periphery of the splitter island framework.

16. The system of claim 14, the lower splitter island frame extending in a first plane and the curb member extending at a generally perpendicular angle to the first plane.

17. The system of claim 15, the lower splitter island frame extending in a first plane and the curb member extending at a non-perpendicular angle with respect to the first plane.

18. The system of claim 1, the splitter island framework including a first portion and a second portion, the first portion being configured to be spaced from the second portion to accommodate a pedestrian walkway between the first portion and the second portion.

19. The system of claim 1, the splitter island framework being formed of a plurality of splitter island framework segments.

20. The system of claim 2, the diverter framework including a lower diverter frame comprising a plurality of interconnected frame segments, an upper diverter frame comprising a plurality of interconnected frame segments, and a plurality of connecting frame segments connecting the lower diverter frame and the upper diverter frame.

21. The system of claim 2, the diverter framework including a first side configured to be positioned adjacent the road edge, and a second side spaced from the first side, the second side including a portion extending in a non-parallel relationship with the first side.

22. The system of claim 2, the diverter framework being formed of a plurality of diverter framework segments.

23. A method for converting an existing traffic intersection into an intersection having a roundabout traffic control feature, the intersection being formed at the junction of a plurality of road sections, each road section extending between road edges, and a road surface defined by the road sections and the intersection, the method comprising:

securing a center island framework to the road surface in a generally central location of the intersection, the center island framework defining a plurality of center island free spaces;

filling the center island free spaces with fill material to form a center island;

securing a splitter island framework to the road surface near the junction of a road section and the intersection, the splitter island framework defining a plurality of splitter island free spaces; and filling the splitter island free spaces with fill material to form a splitter island.

24. The method of claim 23 further comprising:

securing a diverter framework to the road surface near a road edge and the intersection, the diverter framework defining a plurality of diverter free spaces; and filling the diverter framework free spaces with fill material to form a diverter.

25. The method of claim 23, wherein the center island framework is formed of a plurality of center island framework segments, and securing the center island framework to the road surface includes securing the center island framework segments to the road surface to form the center island framework.

26. The method of claim 23, wherein the splitter island framework is formed of a plurality of splitter island framework segments, and securing the splitter island framework to the road surface includes securing the splitter island framework segments to the road surface to form the splitter island framework.

27. The method of claim 24, wherein the diverter framework is formed of a plurality of diverter framework segments, and securing the diverter framework to the road surface includes securing the diverter framework segments to the road surface to form the diverter framework.

28. The method of claim 23, wherein the center island framework includes a an open space or a socket, and further comprising:

positioning a fixture in the open space or the socket.

29. The method of claim 23, wherein the splitter island framework includes a first portion and a second portion, and securing the splitter island framework to the road surface includes securing the first portion spaced from the second portion to accommodate a pedestrian walkway between the first portion and the second portion.

30. The method of claim 23 wherein the existing traffic intersection has a profile formed by a combination of the junction and the plurality of road sections and road edges, the method further comprising:

maintaining the profile after the roundabout traffic control feature is installed.

* * * * *